US011041292B1

(12) United States Patent
Herbert

(10) Patent No.: US 11,041,292 B1
(45) Date of Patent: Jun. 22, 2021

(54) TOILET SPLASH GUARD DEVICE

(71) Applicant: Splash Guard LLC, Jackson, MI (US)

(72) Inventor: Brandon E. Herbert, Jackson, MI (US)

(73) Assignee: Splash Guard LLC, Jackson, MI (US)

( * ) Notice: Subject to any disclaimer, the term of this patent is extended or adjusted under 35 U.S.C. 154(b) by 0 days.

(21) Appl. No.: 16/871,579

(22) Filed: May 11, 2020

(51) Int. Cl.
*E03D 9/00* (2006.01)

(52) U.S. Cl.
CPC ..... *E03D 9/00* (2013.01)

(58) Field of Classification Search
CPC ..... E03D 9/02; E03D 9/022; E03D 2009/024; E03D 2009/026; E03D 2009/028
USPC ..... 4/300.3
See application file for complete search history.

(56) References Cited

U.S. PATENT DOCUMENTS 6,513,172 B1 2/2003 Norton
2005/0235405 A1 10/2005 Dolle
2008/0313795 A1* 12/2008 Lu ..... C11D 7/20 4/231
2018/0347161 A1* 12/2018 Malesky ..... A61L 9/042

FOREIGN PATENT DOCUMENTS

EP 3533943 A1 4/2019

* cited by examiner

*Primary Examiner* — Christine J Skubinna
(74) *Attorney, Agent, or Firm* — Warner Norcross + Judd LLP

(57) ABSTRACT

A urine splatter suppression device and related method are provided. The device can include a base that engages a rim of a toilet, an arm including a corresponding recess and/or projection that engages a base recess and/or a base projection so that the arm is removably supported by the base adjacent the rim, and a deflection plate is joined with the arm and angled between 60 degrees and 90 degrees inclusive relative to the arm and extending transversely inward toward the longitudinal axis of the toilet from the side rim of the toilet. Multiple fingers can extend upward from the deflection plate. The device can be configured so a stream of liquid impinging the plate and/or fingers from above the toilet is dissipated to impair splatter of the stream to an area outside the toilet. A related method of use also is provided.

20 Claims, 10 Drawing Sheets

TOILET SPLASH GUARD DEVICE

BACKGROUND OF THE INVENTION

The present invention relates to lavatory accessories, and more particularly to a splash guard device for use with a toilet.

Usage of a toilet by a male in a standing orientation typically creates issues with regard to the toilet and the surrounding area. For example, when most males urinate into a toilet, the stream of urine typically splatters water, in the bowl of the toilet, upward and out of the toilet. The stream of urine may also be misdirected and splash or splatter on the sides of the bowl, again upward and out of the toilet—or miss the bowl altogether. The resultant splattering leaves the toilet area in an unpleasant and unsanitary condition, requiring cleaning and odor abatement action by the user or others.

There are a variety of urine splash or splatter guards in the market. Some guards drape a fabric over the water in the bowl to reduce splatter. Other guards have an arm that clips to the front rim of the bowl and extends along the center of the bowl with a plate disposed in the center of the bowl. The plate includes fabric and is parallel to and about an inch over water in the bowl. While these and other conventional splatter guards attempt to reduce urine splatter, they suffer several shortcomings. For example, these guards typically deflect the stream in another direction or allow the stream to only partially pass through a fabric, rather than slowing the stream and directing it more usefully. These guards also are difficult to replace in a sanitary manner. Most require a user to touch the guard and remove it. Where the guard is older, there can be malodorous build up on the guard that is unpleasant to contact and/or clean. Further, many conventional guards are placed centrally in the toilet bowl, which can increase the likelihood of contact with the guard when a user is seated on the toilet.

Accordingly, there remains room for improvement in the field of splash suppression to better address the aforementioned issues.

SUMMARY OF THE INVENTION

A urine splatter suppression device is provided, including a base that engages a rim of a toilet, an arm including a corresponding recess and/or projection that engages a base recess and/or a base projection so that the arm is removably supported by the base adjacent the rim, and a deflection plate that is joined with the arm and angled downward relative to the arm and can extend inward from the side rim of the toilet. Multiple fingers can extend upward from the deflection plate. The device can be configured so a stream of liquid impinging the deflection plate and/or fingers from above the toilet is dissipated to impair splatter and/or splash of the stream.

In one embodiment, the base can be configured to be secured to a side rim of a toilet. The base can include an adhesive layer that engages the rim. On an opposite side of the rim, the base can include the projection, which can be a post having a head. The head can be of a larger dimension than the post so that the projection can engage a recess of the arm to suspend the device on the rim.

In another embodiment, the arm can include a rim portion and a bowl portion. The rim portion can include the corresponding recess and/or corresponding projection. The corresponding recess can be configured to receive a post of the base. Where included, the head of the post can engage a rim wall within which the recess is defined in the rim portion, so as to further secure the device to the base.

In still another embodiment, the deflection plate can face generally upward rather than toward the front rim of the toilet. The deflection plate can be suspended an inch or less, or several inches above a level of liquid, such as water, in the toilet. The deflection plate can be generally planar, and a lower planar surface can be angled relative to the water level, for example, at an angle of between 0 degrees and 80 degrees, inclusive, or between 30 degrees and 60 degrees, inclusive. Such angle can appropriately absorb the impact of an impinging liquid stream, and deflect the liquid into the bowl and its water efficiently.

In even another embodiment, the deflection plate can include an upper surface. The optional multiple fingers can extend upward from the upper surface. The fingers can be constructed from a resilient material and can taper down in dimension as each finger extends farther from the deflection plate. The fingers can further assist in absorbing the impact of the impinging liquid stream, dissipate the stream, and yet allow the resulting liquid to travel between adjacent fingers, downward and off a lower edge of the deflection plate.

In yet another embodiment, the fingers and/or the plate can include a fragrance or scent to address odor due to urine on the device or in the toilet. The fingers and/or plate also can include an antimicrobial agent to kill or reduce bacteria on the device in use.

In still another embodiment, the arm can include a transfer element, such as a first transfer projection and/or a first transfer recess. This transfer element can be engaged by a replacement urine splatter suppression device so a user can remove device already installed on the toilet rim with the replacement splatter suppression device in a second mode. As a result of this, a user can use a new device to engage and remove an old device, which may be soiled or coated with urine, without ever manually contacting the old device. The user can then discard the old device and place the new one in its place on the base. The second device can be substantially identical to the old device it replaces, so the removal and replacement and process can be repeated.

In still yet another embodiment, the transfer element can be the first transfer projection in the form of a post extending from the bowl portion of the arm. The post can include a head having a downward projecting flange that extends toward the deflection plate. The flange can also include a distal free end. With this asymmetric head, a user can place the head in a corresponding recess of a replacement device, and the head will temporarily lock in positon so the replacement device has a firm connection with the old device and can be used to remove the old device.

In a further embodiment, a method of use is provided including: providing a first splatter suppression device with a transfer post and/or transfer recess, and engaging the same with a second corresponding recess and/or projection of an identical second splatter suppression device to sanitarily remove the first splatter suppression device from the base without contacting the first splatter suppression device, and replacing the second splatter suppression device on the base, in the toilet.

In still a further embodiment, the method can include providing a base attached to a side rim of a toilet, the base including at least one of a base recess and a base projection; providing a first splatter suppression device including a first arm extending to a first distal end to which a first deflection plate having a first plurality of upright fingers extending away from the first deflection plate, the first arm including at least one of a first corresponding recess and a first corresponding projection that releasably engages the at least one of the base recess and the base projection to suspend the first splatter suppression device within the toilet adjacent the side rim, the first suppression device including at least one of a first transfer projection and a first transfer recess; engaging the at least one of a first transfer projection and a first transfer recess with a respective at least one of a second corresponding projection and a second corresponding recess of a second splatter suppression device including a second arm extending to a second distal end to which a second deflection plate having a second plurality of upright fingers extending away from the second deflection plate; and urging the first splatter suppression device in a direction so that the at least one of a first corresponding recess and a first corresponding projection disengages the at least one of the base recess and the base projection to remove the first splatter suppression device from the base and the toilet with the second splatter suppression device. With this method, a user of the second splatter suppression device need not directly, manually contact the first splatter suppression device when removing the first splatter suppression device from the toilet.

In still yet a further embodiment, the method can include disengaging the first splatter suppression device from the second splatter suppression device; and releasably engaging the at least one of a second corresponding recess and a second corresponding projection with the at least one of the base recess and the base projection to suspend the second splatter suppression device within the toilet adjacent the side rim. The second spatter suppression device can include at least one of a second transfer projection and a second transfer recess.

In even a further embodiment, the method can include orienting the second splatter suppression device so that the second plurality of fingers face downward toward a liquid in the toilet during the urging step; rotating the second splatter suppression device upward so that the second plurality of fingers face upward, away from the liquid; and mounting the second splatter suppression device on the base.

The current embodiments of the splatter suppression device and related method of use provide benefits in preventing or impairing splatter from urination by upright individuals that previously have been unachievable. For example, where the device and its components are designed to be placed on a side rim of the toilet, they do not get in the way of other seated use of the toilet, so the device need not be moved for such seated use. Where the device and the deflection plate are relatively low profile, extending optionally 1 to 4 inches, inclusive, or 2 to 3 inches, inclusive, from the side rim, the device further does not impair seated use of the toilet. Where included, the downward inclined angle of the deflection plate provides appropriate deflection of a liquid stream from above the toilet. The deflection plate can efficiently fragment the stream and direct the stream toward the underlying water in the toilet. Where the fingers are included, the fingers can further dissipate the impact of the liquid stream from above, and assist in channeling the liquid off the deflection plate at a lower end, or through holes defined by the plate and interspersed among the fingers. Where the device includes a transfer element, a replacement splatter suppression device can be used to engage and remove an already installed device without the user having to contact it. This can reduce anxiety for the user in performing the replacement task and improve sanitation.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
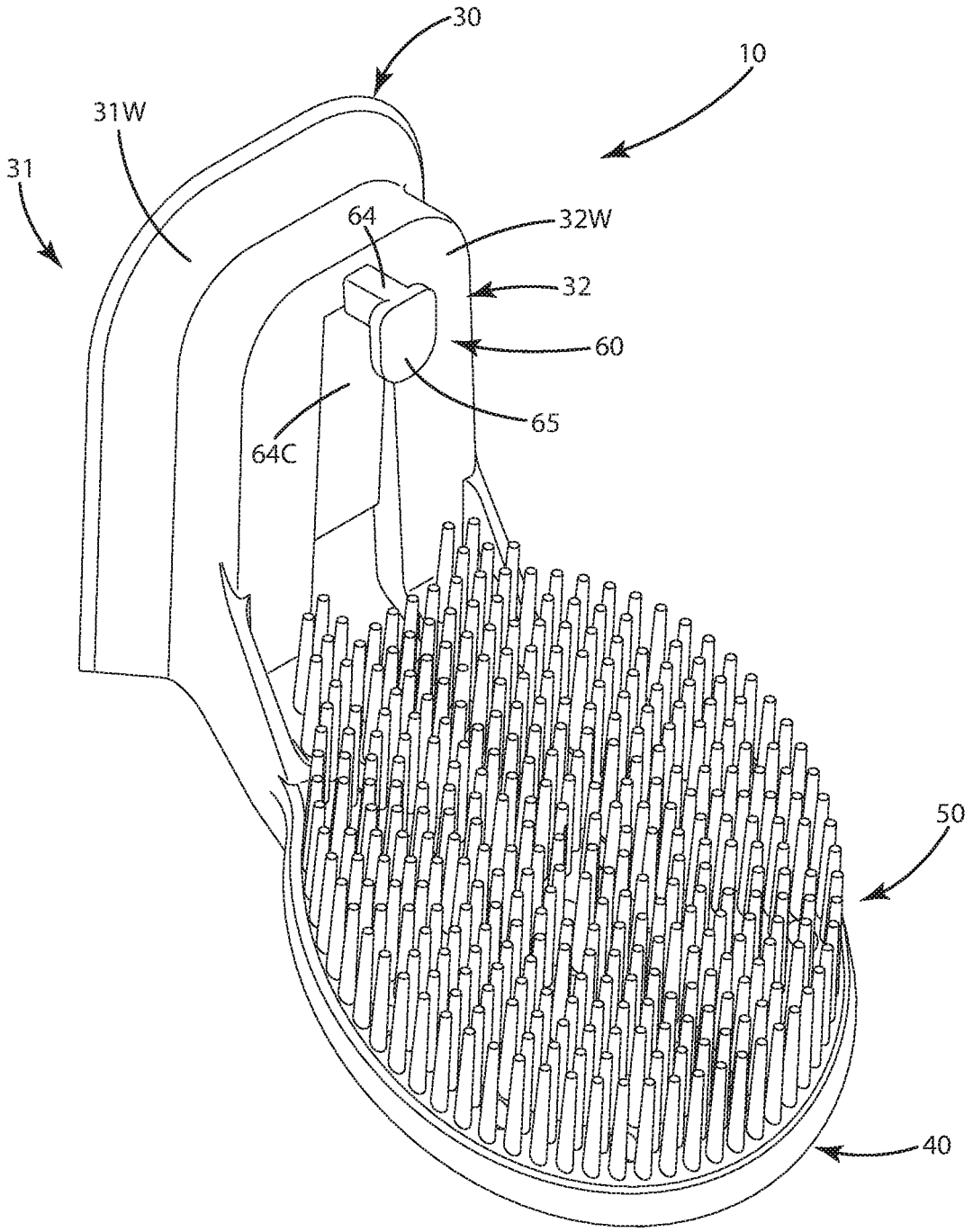
FIG. 1 is a perspective view of the splatter suppression device or splash guard of a current embodiment.
Figure 2:
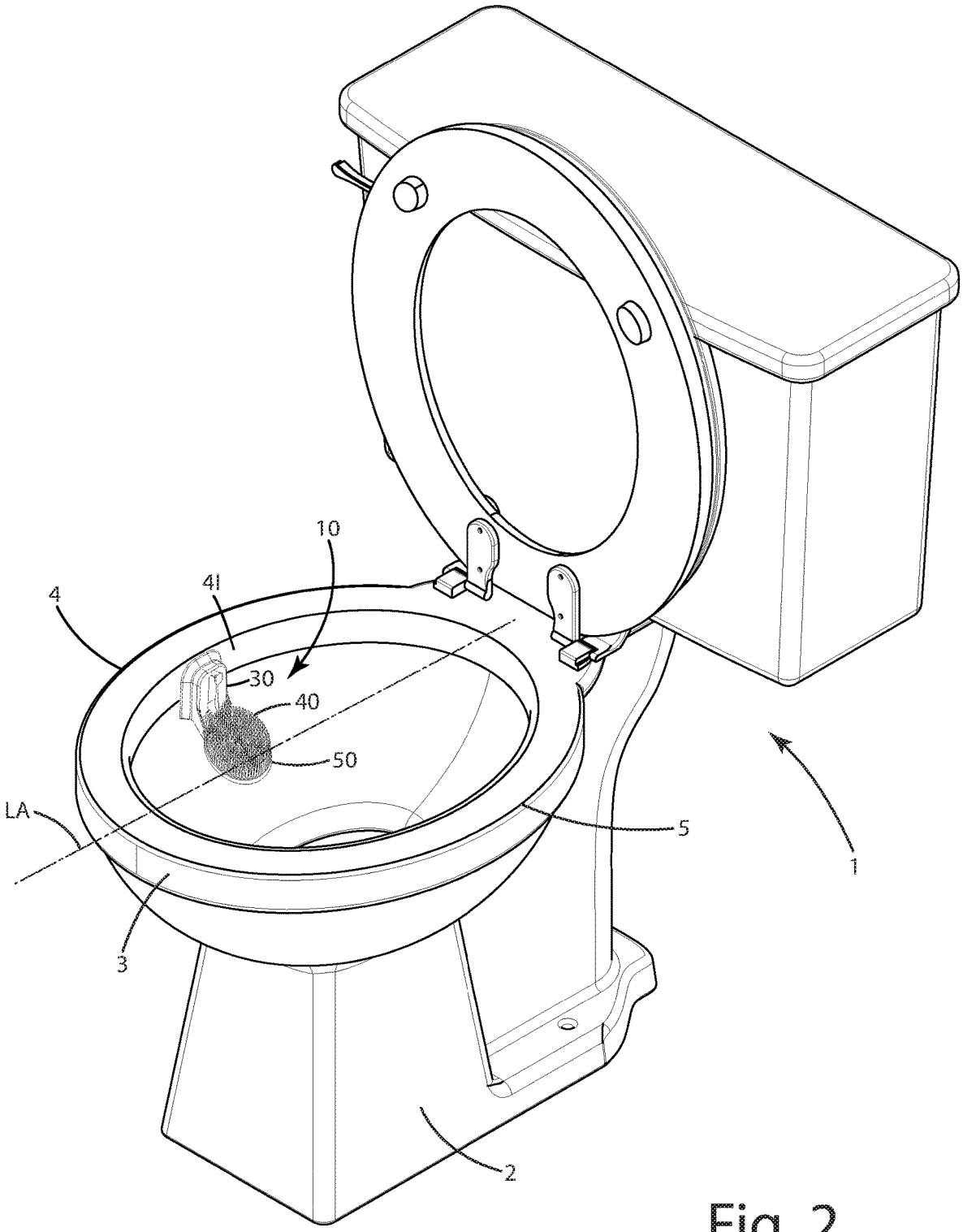
FIG. 2 is another perspective view of the splatter suppression device installed on a rim of a toilet in a first mode suspended by a base thereof.

A current embodiment of the splash suppression device or splash guard is illustrated in FIGS. 1-5, and generally designated 10. The splash suppression device 10 generally includes a base 20, an arm 30 that removably attaches to the base 20, and a deflection plate 40 as described below. The device 10 can be used in conjunction with a variety of lavatory and restroom structures, but is described here in connection with a toilet 1. The toilet 1 as shown in FIG. 2 can include a toilet pedestal 2, a front rim 3 which is the forward most portion of the toilet, and first 4 and second 5 side rims, which lay across a longitudinal axis LA from one another. The toilet further includes a bowl 7 that typically has water W in it. The water typically forms a water level WL. The side rim 4 can include an interior rim surface 41.

Figure 5:
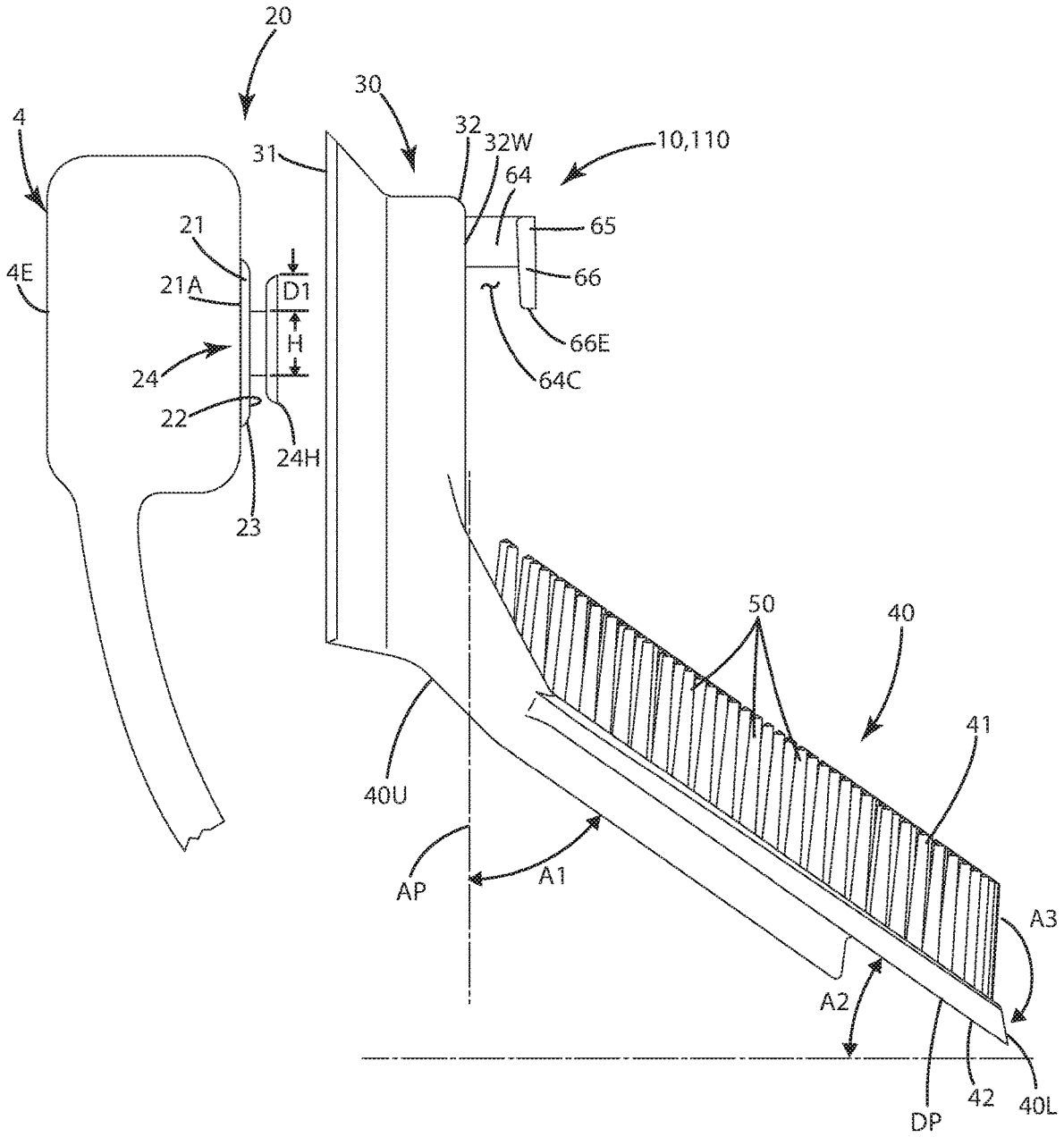
FIG. 5 is a side view of the splatter suppression device with a base thereof separated from an arm thereof.

The device can be secured to the toilet, and in particular to a side rim. As shown in FIG. 5, the base 20 can be joined with and engage the interior surface 41 of the side rim 4. The base can include an interior or first surface 21 that is configured to engage the side rim 4, or 5 depending on placement on the side rims and the user's preference. The first surface 21 can include an adhesive layer 21A applied to it so that the base can be adhered to the rim, for example the interior surface. The adhesive layer can be covered with a release liner before it is exposed and applied to the rim. Of course, in other constructions, the adhesive layer can be absent, and the base can include an arm or a clip that extends over the top 4T of the rim and engages the exterior 4E of the rim to secure the base to the rim. In other cases, the base can be adhered to the side interior and upper surface of the rim, or otherwise fastened with fasteners to the rim.

Figure 8:
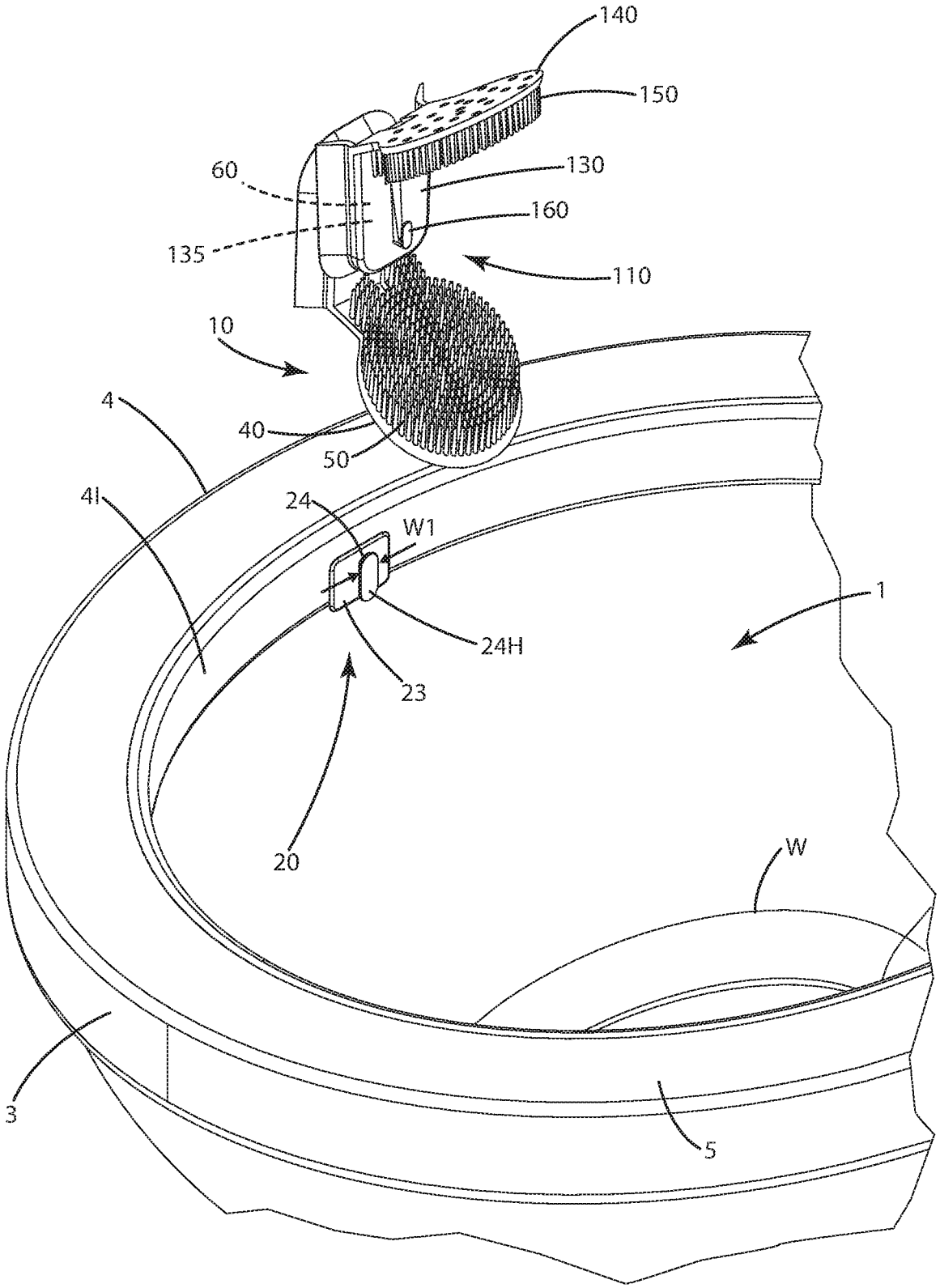
FIG. 8 is a view of the first splatter suppression device engaged with the second splatter suppression device in a second mode removing the same from the toilet.
Figure 9:
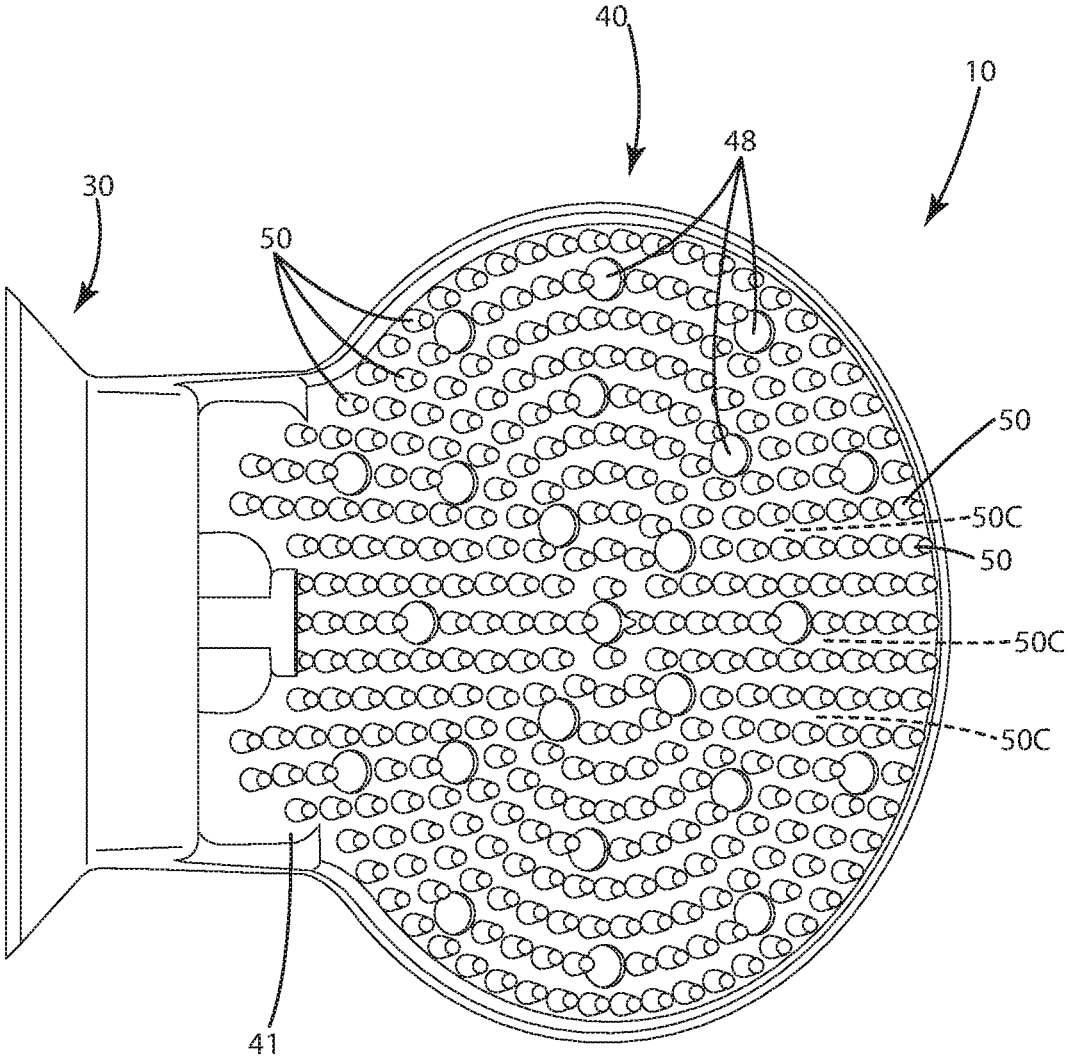
FIG. 9 is a top view of the splatter suppression device.
Figure 10:
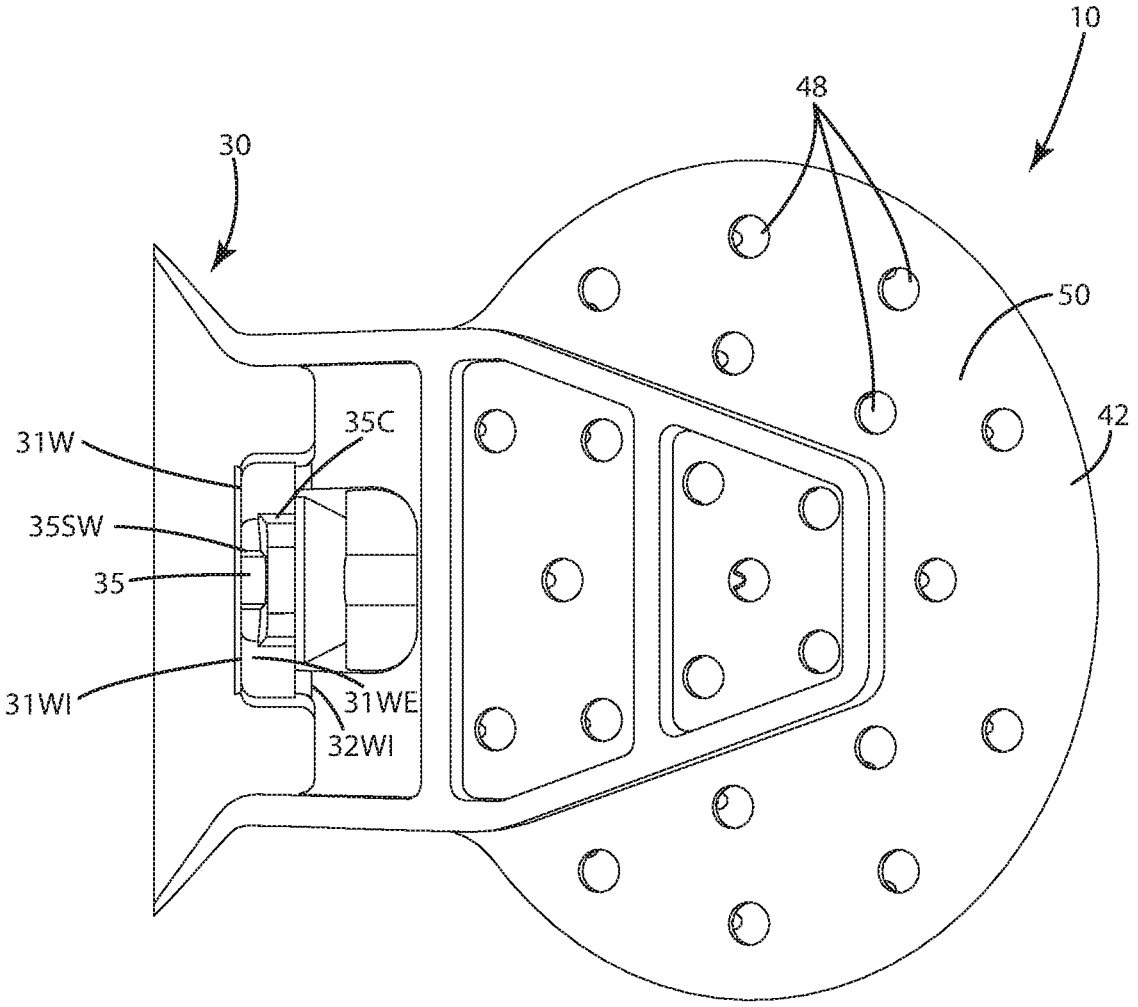
FIG. 10 is a bottom view of the splatter suppression device.

The base shown in FIGS. 5 and 8 can include a plate 23 that forms the first surface. The plate 23 can have a second opposing surface 22 from which a projection 24 extends. The projection can be in the form of a post 24 including a shaft 24S that terminates at a head 24H. The shaft as shown can be elongated and of a plate like form, having a height greater than its thickness or width. Of course, other shafts can be used, of various cross sections such as cylindrical, rectangular, rounded or the like. The head 24H optionally can be in the form of a plate that extends beyond the shaft a distance D1 on all sides of the shaft. This distance can be optionally at least 1 mm, at least 2.5 mm, at least 5 mm, at least 10 mm, or other distances. This plate structure can provide additional contact between the projection and the corresponding recess and arm 30 as described below. Further optionally, as shown, the upper edge of the plate can be rounded to facilitate insertion and interfacing with the arm and recess as also described below. The head 24H also can include a width W1 that is greater than a width W2 of the recess 35 of the arm within which the projection fits when the arm is coupled to the base.

Figure 3:
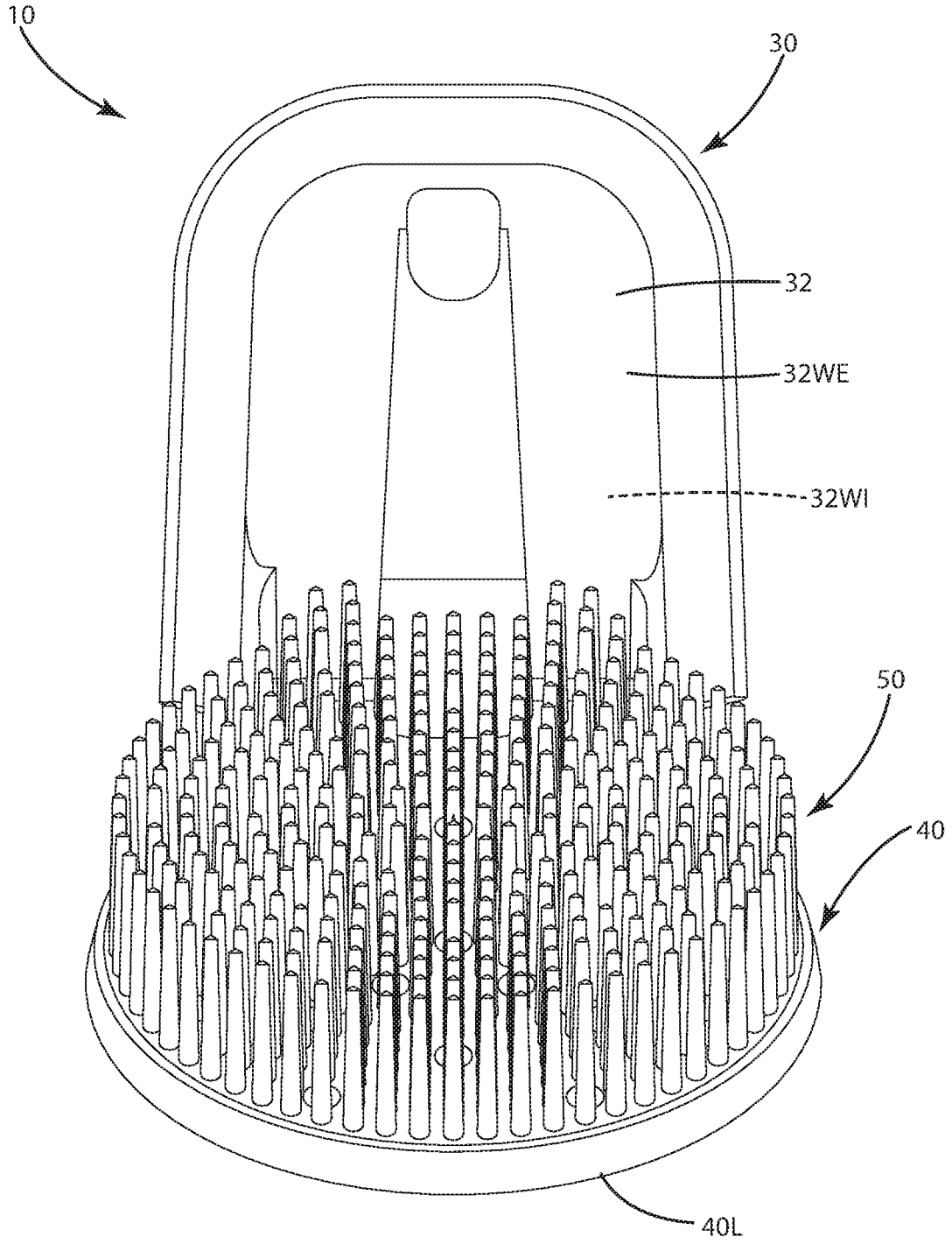
FIG. 3 is a front view thereof.
Figure 4:
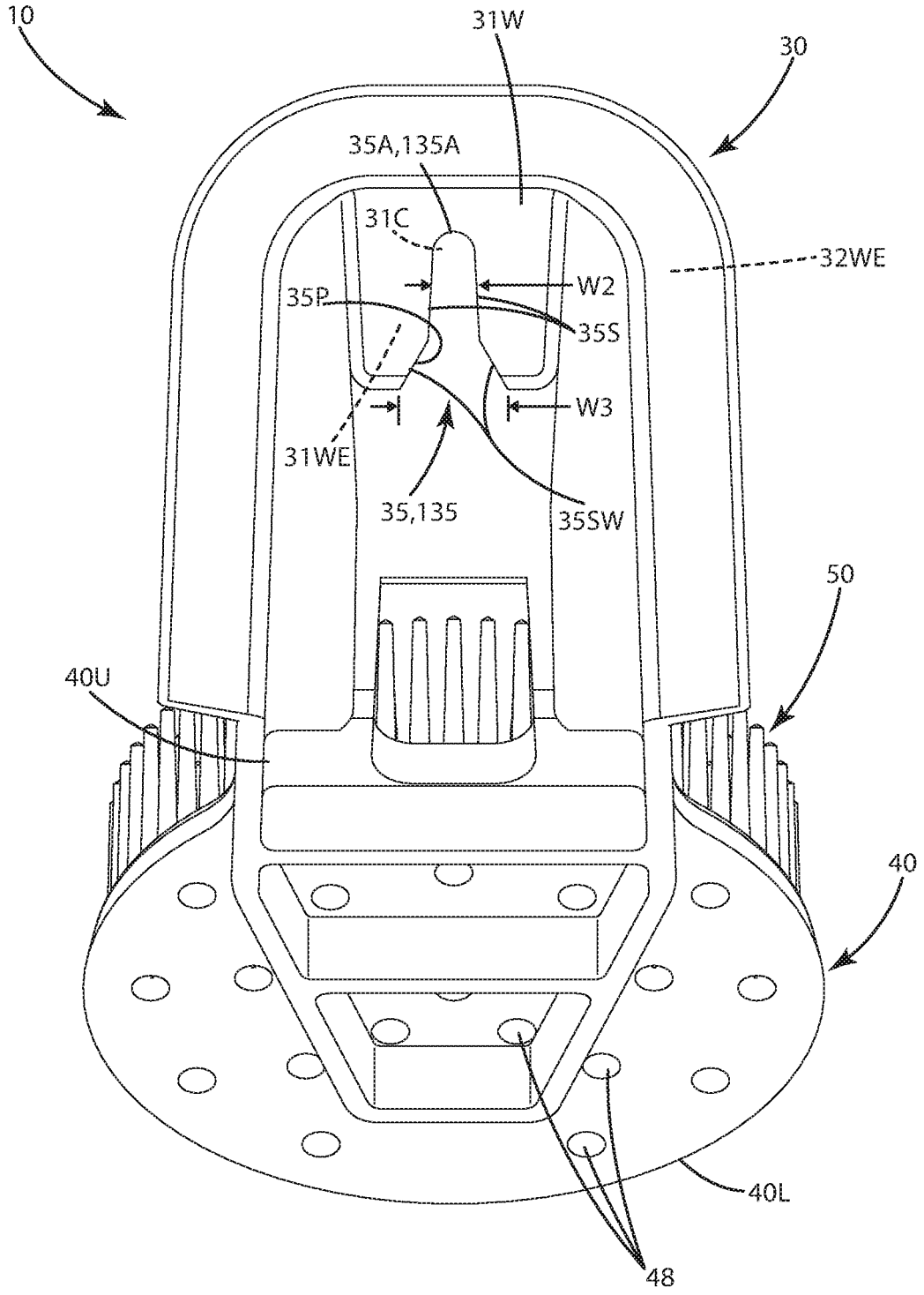
FIG. 4 is a rear view thereof.

The device 10 as mentioned includes an arm. As shown in FIGS. 3-5, the arm 30 can be an upright standing element that is generally parallel to the interior surface 41 of the rim 4 when the device is fully installed. The arm 30 can include a rim portion 31 that generally faces toward the rim and a bowl portion 32 that generally faces outward from the rim 4, toward the longitudinal axis LA. The rim portion 31 can include a rim wall 31W having a rim wall exterior 31WE and a rim wall interior 31WI. The bowl portion 32 can include a bowl wall 32W having a bowl wall exterior 32WE facing toward the longitudinal axis of the toilet and a bowl wall interior 32WI, facing toward the rim wall interior 31WI.

As shown in FIG. 4, the bowl wall 32B can be substantially larger than the rim wall 31W, and only extending in the upper portion of the rim portion. The rim wall 31W and bowl wall 32W can be separated by a space or distance to form a catch cavity 31C therebetween. The catch cavity 31C can be open to a corresponding recess 35 of the arm. The recess 35 can be configured to receive the base projection 24 of the base. In particular, the rim wall 31W can define the corresponding recess 35, with a perimeter wall 35P surrounding the recess. The recess 35 can be bounded by a recess apex 35A and opposing recess sidewalls 35S. The recess apex can be located above the recess sidewalls, which extend downward and away from the recess apex. The recess apex can be rounded or curvilinear as shown, or can be polygonal or angled depending on the application. The shape of the apex and sidewalls can correspond to the post and shaft 24 of the base projection, and can generally direct the post into the recess toward the apex when the device 10 is installed on the base under the force of gravity. The recess also can include a converging portion 35C, which as shown in FIG. 4 includes secondary walls that 35SW that taper, angle or converge toward one another as they extend toward the sidewalls 35S of the recess. These angled walls can function to guide the projection 24 into the narrower space between the sidewalls 35S. The narrower space between the sidewalls can hold the post more tightly, so that the arm does not wobble much relative to the projection or base when installed. Of course, the angled walls can be eliminated in some applications. It also will be appreciated that the corresponding recess and base projection structures can be reversed, so the projection is on the rim portion and the recess is defined by the base. Even with this reversed structure, the device can still function similarly and can be installed and removed in a similar manner as the structure show. Also, it is noted that such base projection and base recess structures can be referred to as base attachment elements, and such corresponding projection and corresponding recess structures of the arm can be referred to as corresponding elements or corresponding arm elements herein.

When the arm is installed on the base, the head 24H also can be disposed in the cavity 31C. The head, as mentioned above can have a width W1 greater than the width of the recess W1, for example, between sidewalls 35S. The opening by the angled walls 35SW however, can have a width W3 which is greater than the head width W1 so that the head 24H can fit into the cavity 31C. With this configuration, the head can be slid into the opening with the width W3, then be trapped in the cavity due to the narrower width W2 of the recess between sidewalls 35S. The head in this position can be blocked from removal from the recess via the head engaging the rim exterior wall 31WE around the perimeter 35P. When the arm is installed on the base, in an installed mode sometimes referred to as a first mode, the projection, in particular, the post 24 also can engage the recess apex 35A. In the first mode, the post 24 also can engage one or more of the sidewalls 35S or other parts of the perimeter 35P. With the elongated height H1 of the post 24, the past also is less prone to rotate in the elongated recess, between the sidewalls 35S. Of course, where the post is rounded or cylindrical, the arm and/or base can be outfitted with other features that impair rotation of the arm and deflection plate relative to the base.

With reference to FIGS. 1, 3 and 5, the arm can extend downward to a lower end to which the deflection plate 40 is joined. In some cases, the arm can include a support extension and/or secondary arms that extend under the plate to provide further support to that plate as shown. The deflection plate 40 can include an upper end 40U and a lower end 40L, with the plate angled downward from the upper end to the lower end. The deflection plate can include an upper surface 41 and an opposing a lower surface 42. These surfaces can be generally planar as shown. The plate 40 itself can be of a rounded or circular aesthetic configuration, but of course can be of other shapes depending on the application. The secondary extension can attach to the lower surface, and can stop short of the lower end in some applications.

The deflection plate 40 can include a deflection plate reference plane DP parallel to and/or coincident with the lower surface 42. Optionally, the deflection plate 40 can include a multitude of independent fingers 50 extending upward from the upper surface, generally away from the deflection plate reference plane DP. The fingers can each be optionally of a length greater than 1 mm, greater than 2 mm, greater than 3 mm, greater than 4 mm, greater than 5 mm, greater than 10 mm, or other lengths depending on the application. The individual fingers can be spaced from one another on the upper surface, and optionally can be connected to a common mat that can be joined with the upper surface. The fingers 50 can form a multitude of individual channels and passages 50C therebetween, through which liquid can flow down the plate toward the lower end 40L of the plate, off of which the liquid drips. Generally, the fingers are configured so that a stream of liquid impinging the fingers from above the toilet is dissipated by the fingers into a plurality of streams that drip from the deflection plate to impair splatter of the stream to an area outside the toilet.

Optionally, the fingers 50 as shown can be of a pointed, tapering configuration. As an individual finger 50 extends away from the upper surface 41, it can reduce in dimension. For example, with a rounded finger, the diameter near the plate can be larger than the diameter of the same finger farther than the plate. Of course, the diameter or other dimension can be constant, or can vary in some other manner extending from the deflection plate.

In some applications, the fingers 50 can be constructed from a resilient material, such as silicone, rubber or polymers. The material can be scented and/or scent releasing to provide a particular scent to the device and the toilet in general. Optionally, the remainder of the splash suppression device and its various components can be constructed from a polymeric material, such as plastic, which can be relatively resistant to absorbing or retaining liquids and odors, and which is resistant to degradation and/or discoloration by urine. Returning to the fingers, those elements can be angled at some angle A3 to the deflection plate reference plane DP. For example, the fingers can be angled at an angle A3 relative to the plane DP that can be optionally between 80 degrees and 140 degrees, inclusive, between 90 degrees and 120 degrees, inclusive, or between 100 degrees and 150 degrees inclusive. Other angles are contemplated, as well as non-perpendicular angles.

Further optionally, the deflection plate 40 can define a plurality of plate holes 48 that extend from the upper surface to the lower surface. These plate holes can allow liquid impinging the plate and/or fingers to travel through the plate, through these holes. The plate holes shown are round or circular, but can take a variety of other geometric shapes.

The deflection plate 40 also can be in a particular orientation relative to the arm and the rim. Generally, the plate can extend outward away from the side rim toward the longitudinal axis LA of the toilet as shown in FIG. 2. Put another way, the deflection plate can extend transversely inward toward the longitudinal axis of the toilet from the side rim of the toilet. In this configuration, the deflection plate is distal from the longitudinal axis, and also located away from the front and rear rims of the toilet. The deflection plate 40 also can face substantially upward rather than toward the front rim of the toilet, with the upper surface facing upward. As shown in FIG. 5, the deflection plate 40 and its plane DP can be angled at an angle A1 relative to the arm 30, and in particular the arm reference plane AP, which can be formed by the bowl wall 32W of the arm. This arm reference plane AP also can be substantially parallel to the side rim 4, and optionally the interior rim surface 41, in which case, the angle A1 also can be formed between the deflection plate plane DP and that rim and/or rim surface. The angle A1 can be optionally between 60 degrees and 90 degrees inclusive, between 60 degrees and 45 degrees inclusive, between 70 degrees and 30 degrees inclusive, or less than 90 degrees. These angles have been discovered to provide surprising results by reducing excessive splatter from a liquid stream impinging the deflection plate and fingers, and ultimately channeling well the fragmented stream into the water W below the deflection plate.

Optionally, the water W can have a water level WL in the toilet, laying in a substantially horizontal plane, as shown in FIG. 5. Incidentally, the water level WL in FIG. 5 is shown for illustrative purposes, and can be farther or closer to the deflection plate depending on the particular type of toilet in use. In some cases, the water level may be less than one inch, an inch, or several inches below the deflection plate, farther than as shown. The deflection plate can be oriented at a fixed, immovable position above the water and relative to the rim when the device is installed. The deflection plate 40 and its plane DP also can be oriented at an angle A2 relative to the water level. The angle A2 can be optionally between 60 degrees and 90 degrees inclusive, between 60 degrees and 45 degrees inclusive, between 70 degrees and 30 degrees inclusive, or less than 90 degrees.

With reference to FIGS. 1, 3 and 5, the splatter suppression device 10 can include a corresponding transfer element 60, which can be in the form of at least one of a first transfer projection and a first transfer recess configured to engage a replacement urine splatter suppression device so a user can remove the old device from the base. In particular, as shown the transfer element 60 can be in the form of a first transfer projection, or a first transfer recess in other applications. As shown, the transfer element in the form of a transfer projection can include a post 64 that extends from the bowl portion 32, in particular the exterior of the bowl wall outward over the deflection plate and/or the fingers 50. Optionally, the projection can include a ramp (not shown) extending up to it to enhance its strength and capture of a portion of a replacement device to assist in removing the one already installed on the base 20. The projection can include a head 65 attached to the post 64. The head optionally can include a downward projecting flange 66 that extends toward the deflection plate. This flange can be cantilevered, and can terminate at a distal free end 66E. The flange, post and bowl wall can cooperatively form a capture recess 64C, within which an apex of a recess of another device can be captured, so that a user can use the replacement device to exert a force on the old device and remove it from the base as described below.

Figure 6:
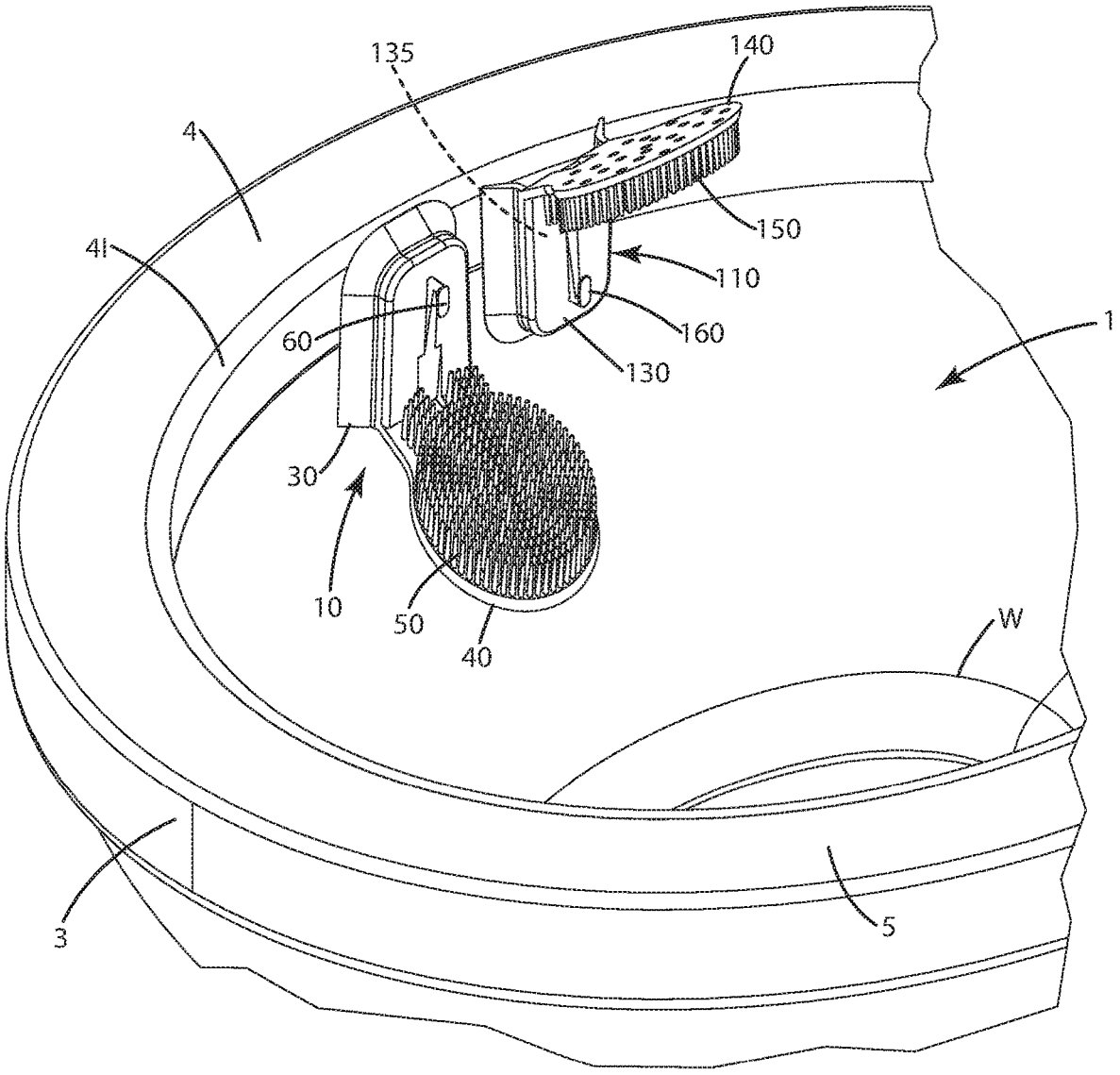
FIG. 6 is a view of a first splatter suppression device about to be engaged with a second splatter suppression device to remove and replace the first splatter suppression device with the second splatter suppression device.
Figure 7:
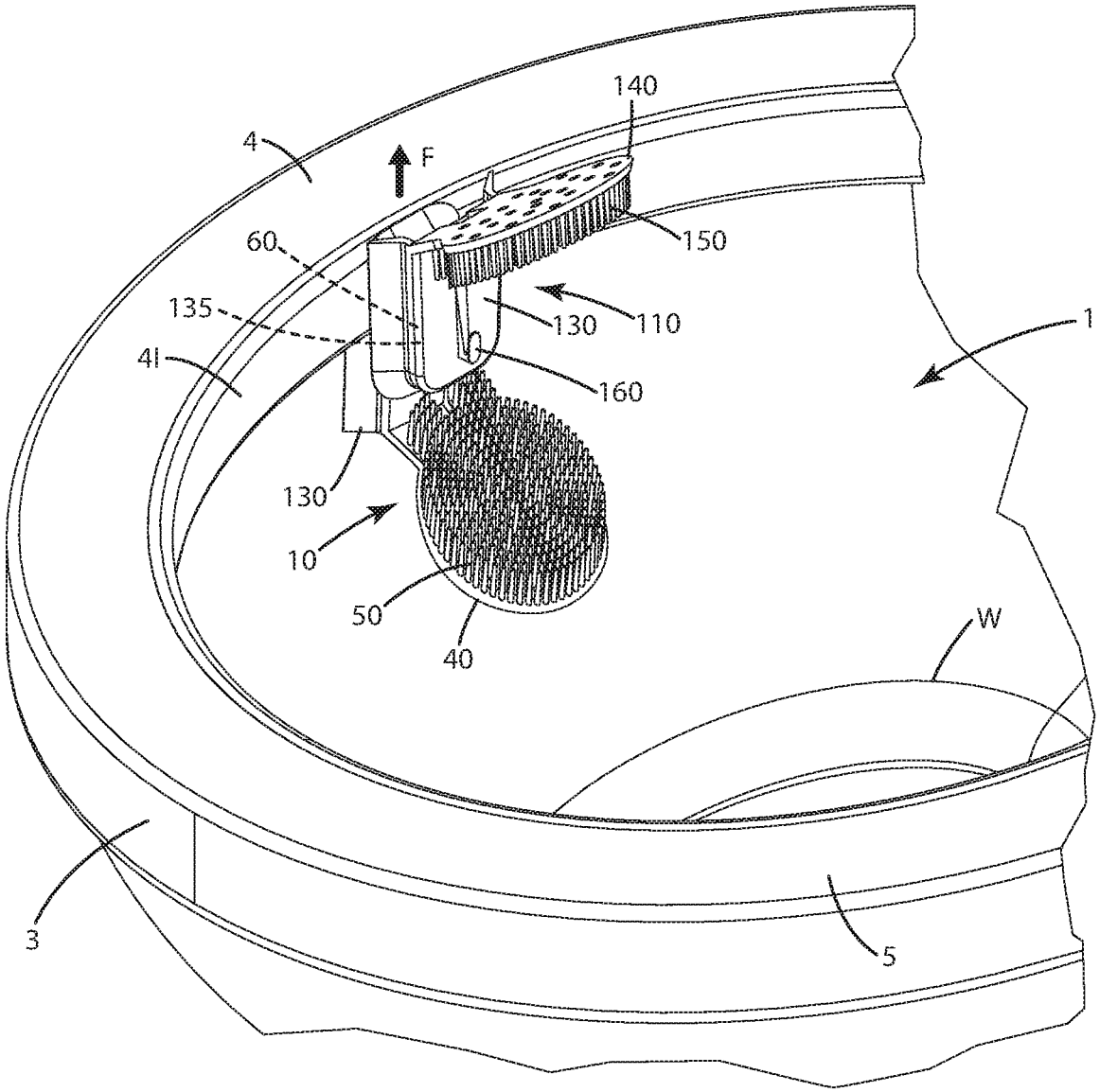
FIG. 7 is a view of the first splatter suppression device engaged with the second splatter suppression device and about to remove the same from the toilet.

A method of using the splatter suppression device, in particular, a method of replacing a unit, will be described with reference to FIGS. 5-8. In general, the method can include providing a base 10 attached to a side rim 4 of a toilet 1, the base including a base attachment element 20; providing a first splatter suppression device 10 including a first arm 30 extending to a first distal end to which a first deflection plate 40 having a first plurality of upright fingers 50 extending away from the first deflection plate 40, the first arm including a first corresponding arm element 35 that releasably engages the base attachment element 20 to suspend the first splatter suppression device 10 within the toilet 1 adjacent the side rim 4 so the first deflection plate 40 is immovably fixed at an angle A1 relative to a side rim 4 and/or its surface 41 of the toilet I. The first suppression device 10 can include a first transfer element 60. The method can include providing a second splatter suppression device 110, which has the same structures and features as the first splatter suppression device 10, except optionally a base is not attached to the second device 110, as shown in FIG. 6. As shown in FIG. 7, the method can include engaging the first transfer element 60 with a respective corresponding arm element 135 (FIG. 4) of a second splatter suppression device 110 including a second arm 130 extending to a second distal end to which a second deflection plate 140 having a second plurality of upright fingers 150 extending away from the second deflection plate. The method can include urging the first splatter suppression device 10 in a direction, optionally upward, but other directions are suitable depending on the construction, as shown in FIG. 8. Upon such movement, the first corresponding element 35 of the first splatter suppression device 10 disengages the base attachment element 24 and base 20 in general, to remove the first splatter suppression device 10 from the base and the toilet 1 with the second splatter suppression device 110. In this manner, a user need not directly, manually contact the first splatter suppression device 10 when removing the first splatter suppression device from the toilet.

The method will be described with more particularity starting with FIGS. 4 and 6. The second device 110 as mentioned above, can have the same structure and features as the first device 10. It can include the arm 130 and the bowl and rim portions, walls, rims etc., and in particular, the arm corresponding element, which as shown in FIG. 4 is a corresponding recess 135, but of course could just as well be a projection if the base includes a base recess. The recess 135 can have all the features of the recess 35, and can be identical to the same.

As shown in FIG. 6, the second device can be turned upside down, so that the deflection plate 140 and optional fingers 150 face downward, toward the bowl and the water W in the bowl. The arm 130 can be moved toward the arm 30 of the first device 10, with the objective of aligning the now upside down recess 135 with the transfer element 60 on the first device attached to the base 20 on the rim 4. The user can continue to move the second device 110 toward the first device 10 so that the arms 30 and 130 are adjacent one another. The first transfer element 60 can enter the recess 135. The head 65 and flange 66 of the first device (FIG. 5) can enter into a cavity of the second device, like the cavity 31C of the first device 10. The apex 135A of the recess 135 or some other part of the arm can engage the post 64 upon moving the second device slightly upward. The arm 130 parts can enter into the cavity 64C of the first device, until the corresponding arm element 135 sufficiently engages the first transfer element 60 as shown in FIG. 7.

Upon such engagement of the first device 10 with the second device 110 in FIG. 7, the user can exert an upward force F on the second device 110, which is transferred to the first device 10. As a result, the first device begins to move upward, and in so doing, the recess 35 and associated arm 30 of the first device 10 begin to disengage the base attachment element 24. In effect, the recess 35 moves upward relative to the base post 24. The base head 24H exits the cavity 31C upon further movement upward. Optionally, the second splatter suppression device is oriented so that the second fingers 150 and plate 140 face downward toward a liquid W in the toilet during the engagement step, and as the first device is urged to disengaged the base 20.

When the base projection or element 24 no longer engages the first device 10, the first device separates from the base 20, being move upward and/or away from the base as shown in FIG. 8 with the second device. During this movement and removal, the second device 110 can be the only thing contacting the first device 10, which can be contaminated with urine or fecal matter in the toilet. Thus, the user need not contact the old, used first device to remove and replace it.

After the first device 10 is removed from its base 20, the user can then use the second device 110 to transport the first device 10 to another location and discard it. To do so, the user can turn the second device and first device upside down so that the first device disengages and optionally falls off the second device, with the transfer element and corresponding arm element disengaging one another. After the first device is removed from the second device, the user can install the second device 110 on the base 20. Optionally, before doing so, the user can rotate the second splatter suppression device 110 upward so that the second fingers 150 will face upward, away from the liquid W in the toilet when being installed on the base.

For installation, the user can move the second device in direction M shown in FIG. 5 so that the base attachment element 24 engages the second corresponding arm element 135, which can be a second corresponding recess and/or a second corresponding projection, to suspend the second splatter suppression device 110, also referred to as a replacement splatter suppression device herein, within the toilet adjacent the side rim 4. When the second device 110 is installed on the base 10, the second deflection plate 140 can be immovably fixed at an angle between 60 degrees and 90 degrees inclusive relative to a side time surface of the toilet. Optionally, the second suppression device 110 can include a second transfer element 160 so that after it is used up or ready to be removed from the base 20, another third splatter suppression device can be used to remove it, similar to the manner in which the first device was removed.

In some cases, the splatter suppression device herein can be packaged with multiple components. For example, a package can include more than one of the devices, for example a first device 10, a second device 110, and a third device, all of which can be identical. The package, however, can come with a single base, so that the devices can be replaced several times relative to that base. In other cases, several bases may be included with one or more devices. In yet other cases, one device and one base can be includes in a package, with the device not including any type of transfer element. It will be appreciated that even though one base may be used with multiple arms and deflection plates of the devices herein, the base and those components can still be considered a splatter suppression device.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A urine splatter suppression device comprising:

a base including a base plate having a first surface configured to engage a side rim of a toilet and a second surface, the base including a base projection extending from the second surface;

an arm including a rim portion configured to face the rim surface, and a bowl portion configured to face inward toward a longitudinal axis of the toilet, the rim portion defining a first recess sized and shaped to receive the base projection of the base so that the arm is removably supported on the base projection adjacent the base in a first mode, the arm extending below the base toward an arm distal end, the arm including an arm reference plane that is generally vertical in the first mode;

a deflection plate joined with the arm at the distal end, the deflection plate angled between 60 degrees and 90 degrees inclusive relative to the arm reference plane in the first mode, the deflection plate extending transversely inward toward the longitudinal axis of the toilet from the side rim of the toilet, distal from a front rim of the toilet, the deflection plate including an upper surface, a lower surface, a deflection plate reference plane parallel to the lower surface, and a deflection plate lower end; and a plurality of fingers extending upward from the upper surface and away from the deflection plate plane, whereby a stream of liquid impinging the plurality of fingers from above the toilet is dissipated by the plurality of fingers into a plurality of streams that drip from the deflection plate to impair splatter of the stream to an area outside the toilet.

2. The urine splatter suppression device of claim 1, wherein the bowl portion of the arm includes a transfer element configured to be captured in a corresponding element of a replacement urine splatter suppression device so a user can remove the base projection from the first recess in a second mode in which the arm is disengaged from the base so the arm is no longer supported by the base and the base is readied for installation of the replacement splatter suppression device thereon.

3. The urine splatter suppression device of claim 1, wherein the deflection plate defines a plurality of apertures extending from the upper surface to the lower surface, between the plurality of fingers.

4. The urine splatter suppression device of claim 1, wherein the base projection is in the form of a post terminating at a post head, wherein the recess is bounded by a recess apex and opposing recess sidewalls, wherein the recess apex is located above the recess sidewalls, wherein the post engages the recess apex in the first mode.

5. The urine splatter suppression device of claim 4, wherein the rim portion includes a rim wall having a rim wall exterior and a rim wall interior, wherein the bowl portion includes a bowl wall having a bowl wall exterior facing toward the longitudinal axis of the toilet and a bowl wall interior, facing toward the rim wall interior.

6. The urine splatter suppression device of claim 5, wherein the recess is defined by the rim wall, wherein the post head is disposed between the rim wall interior and the bowl wall interior in the first mode.

7. The urine splatter suppression device of claim 1, wherein the first surface of the base includes an adhesive layer that adhesively secures the base to the side rim of the toilet.

8. The urine splatter suppression device of claim 1, wherein the deflection plate is angled between 45 degrees and 60 degrees inclusive relative to the arm reference plane in the first mode.

9. The urine splatter suppression device of claim 8, wherein the deflection plate faces generally upward rather than toward the front rim of the toilet.

10. The urine splatter suppression device of claim 1, wherein the plurality of fingers are constructed from a resilient material and taper down in dimension as each finger extends farther from the deflection plate.

11. A urine splatter suppression device comprising:

a base including a base plate having a first surface configured to engage a side rim of a toilet and a second surface, the base including a base attachment element;

an arm including a rim portion configured to face the side rim, and a bowl portion configured to face inward toward a longitudinal axis of the toilet, the rim portion including a corresponding element that engages the base attachment element so that the arm is removably supported on the base adjacent the side rim in a first mode, so that the arm can be removed from the base while the base remains attached to the side rim in a second mode, the arm including an arm reference plane that is generally vertical in the first mode;

a deflection plate joined with the arm and angled between 45 degrees and 90 degrees inclusive relative to the arm reference plane in the first mode, the deflection plate extending transversely inward toward the longitudinal axis of the toilet from the side rim of the toilet; and a plurality of elongated fingers extending upward from the deflection plate, whereby a stream of liquid impinging the plurality of fingers from above the toilet is dissipated by the plurality of fingers to impair splatter of the stream to an area outside the toilet.

12. The urine splatter suppression device of claim 11, wherein the bowl portion of the arm includes a first transfer element configured to engage a replacement urine splatter suppression device so a user can remove the arm from the base in a second mode so the arm is no longer supported by the base and the base is readied for installation of the replacement splatter device.

13. The urine splatter suppression device of claim 12, wherein the first transfer element is a post including a head having a downward projecting flange that extends toward the deflection plate, the flange including a distal free end.

14. The urine splatter suppression device of claim 11, wherein the plurality of fingers project at an angle that is not perpendicular to a deflection plate plane of the deflection plate.

15. The urine splatter suppression device of claim 11, wherein the bowl portion includes a bowl wall having a bowl wall interior and a bowl wall exterior, wherein the corresponding element is at least one of a recess and a corresponding projection that is disposed between the side rim and the bowl wall interior in the first mode such that the at least one of a corresponding recess and a corresponding projection is concealed by the bowl portion.

16. A method of using a urine splatter suppression device comprising:

providing a base attached to a side rim of a toilet, the base including at least one of a base recess and a base projection;

providing a first splatter suppression device including a first arm extending to a first distal end to which is joined a first deflection plate having a first plurality of upright fingers extending away from the first deflection plate, the first arm including at least one of a first corresponding recess and a first corresponding projection that releasably engages the at least one of the base recess and the base projection to suspend the first splatter suppression device within the toilet adjacent the side rim so the first deflection plate is immovably fixed at an angle between 60 degrees and 90 degrees inclusive relative to a side rim surface of the toilet, the first suppression device including at least one of a first transfer projection and a first transfer recess;

engaging the at least one of a first transfer projection and a first transfer recess with a respective at least one of a second corresponding projection and a second corresponding recess of a second splatter suppression device including a second arm extending to a second distal end to which a second deflection plate having a second plurality of upright fingers extending away from the second deflection plate; and urging the first splatter suppression device in a direction so that the at least one of a first corresponding recess and a first corresponding projection disengages the at least one of the base recess and the base projection to remove the first splatter suppression device from the base and the toilet with the second splatter suppression device, whereby a user of the second splatter suppression device need not directly, manually contact the first splatter suppression device when removing the first splatter suppression device from the toilet.

17. The method of claim 16 comprising:

disengaging the first splatter suppression device from the second splatter suppression device; and engaging the at least one of a second corresponding recess and a second corresponding projection with the at least one of the base recess and the base projection to suspend the second splatter suppression device within the toilet adjacent the side rim so the second deflection plate is immovably fixed at an angle between 60 degrees and 90 degrees inclusive relative to a side time surface of the toilet, the second splatter suppression device including at least one of a second transfer projection and a second transfer recess.

18. The method of claim 16, wherein the second splatter suppression device is oriented so that the second plurality of fingers face downward toward a liquid in the toilet during the urging step.

19. The method of claim 18 comprising:

rotating the second splatter suppression device upward so that the second plurality of fingers face upward, away from the liquid; and mounting the second splatter suppression device on the base.

20. The of method of claim 16, wherein the base projection is a base post, wherein the first arm includes a first corresponding recess, wherein the base post fits in the first corresponding recess to support the first splatter suppression device over a liquid in the toilet, wherein the first splatter suppression device includes the first transfer projection.

* * * * *